US007178567B2

(12) United States Patent
Mangano

(10) Patent No.: US 7,178,567 B2
(45) Date of Patent: Feb. 20, 2007

(54) EXPANDABLE BAG

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 11/009,600

(22) Filed: Dec. 10, 2004

(65) Prior Publication Data

US 2006/0124213 A1 Jun. 15, 2006

(51) Int. Cl.
*A45C 7/00* (2006.01)
*A45C 13/10* (2006.01)
*A45C 13/28* (2006.01)

(52) U.S. Cl. ..... 150/103; 150/107; 150/108; 150/112; 190/105; 190/115; 383/2; 383/4

(58) Field of Classification Search ..... 190/103–105, 190/107, 115; 383/2, 4; 150/103, 107, 108
See application file for complete search history.

(56) References Cited

U.S. PATENT DOCUMENTS

| | | | | | |
|---|---|---|---|---|---|
| 101,910 | A * | 4/1870 | Patten | 190/103 |
| 672,143 | A | 4/1901 | Boughner | |
| 1,060,824 | A * | 5/1913 | Cunningham | 190/104 |
| 2,080,252 | A * | 5/1937 | Cook et al. | 383/90 |
| 2,212,390 | A * | 8/1940 | Conklin | 383/2 |
| 2,454,013 | A | 11/1948 | Scherzinger | |
| 2,575,893 | A * | 11/1951 | Seaman | 383/25 |
| 2,672,903 | A | 3/1954 | Machinist | |
| 2,729,257 | A | 1/1956 | Kepper | |
| 3,229,741 | A * | 1/1966 | Ambrose | 383/2 |
| 3,746,066 | A | 7/1973 | McIntyre | |
| 4,062,392 | A * | 12/1977 | Ishii | 383/2 |
| 4,148,347 | A | 4/1979 | Seaman | |
| 4,153,146 | A * | 5/1979 | Patton et al. | 190/103 |
| 4,177,909 | A * | 12/1979 | Haskell | 224/153 |
| 4,613,039 | A * | 9/1986 | Shaw et al. | 206/287.1 |
| 4,756,394 | A | 7/1988 | Cohen | |
| 4,856,570 | A * | 8/1989 | Rushing et al. | 150/107 |
| 5,038,842 | A | 8/1991 | Huang | |
| 5,211,716 | A * | 5/1993 | Tobias | 190/103 |
| 5,289,906 | A * | 3/1994 | Guidi | 190/107 |
| 5,664,652 | A | 9/1997 | Shamah | |
| 5,797,529 | A * | 8/1998 | Lavine | 224/575 |
| 6,640,856 | B1 * | 11/2003 | Tucker | 150/130 |
| 2001/0015248 | A1 | 8/2001 | McCreery | |
| 2001/0031104 | A1 * | 10/2001 | Vazquez | 383/2 |

* cited by examiner

*Primary Examiner*—Sue A. Weaver
(74) *Attorney, Agent, or Firm*—Galgano & Associates, PLLC

(57) ABSTRACT

An expandable bag includes a body having a lower portion defining a closed bottom and a generally upstanding lower sidewall having an upper rim defining an upper opening and an upper portion defining an upper sidewall having a lower edge coupled adjacent to the upper edge of the lower portion and having an upper rim defining a top opening. The upper portion is movable between a folded position, in which the upper sidewall is folded within the lower sidewall such that the upper rim of the upper portion and the top opening thereof is disposed generally adjacent to the upper edge of the lower portion to define an interior compartment of a certain size, and an extended position, in which the upper portion is unfolded and extended upwardly, thereby extending the height of the body and, in turn, the bag creating an interior compartment of greater size.

23 Claims, 5 Drawing Sheets

EXPANDABLE BAG

BACKGROUND OF THE INVENTION

1. Field of the Invention

The invention relates generally to an expandable bag. More particularly, the invention relates to a woman's hand bag or tote and, in particular, a shoulder bag which is vertically expandable.

2. Brief Description of the Prior Art

Frequently during shopping or traveling it is discovered that a carrying bag is not large enough to accommodate the additional items accumulated during the trip. The prior art discloses many different kinds of expanding bags which address this problem. However, all of these bags are of relatively complicated construction, cumbersome and/or aesthetically displeasing.

SUMMARY OF THE INVENTION

It is therefore an object of the invention to provide a carrying bag such as a woman's hand bag or tote and, in particular, an expandable shoulder bag.

It is also an object of the invention to provide an expandable shoulder bag which is easy to use and aesthetically pleasing.

It is another object of the invention to provide an expandable shoulder bag which in its unexpanded state appears conventional and is not readily discernable as an expandable bag.

Certain of the foregoing and related objects are readily attained according to the present invention by the provision of an expandable bag comprising a body having a relatively rigid, lower portion defining a closed bottom and a generally upstanding lower sidewall having an upper rim defining an upper opening and a relatively flexible upper portion defining an upper sidewall having a lower edge coupled adjacent to said upper edge of said lower portion and having an upper rim defining a top opening, said upper portion being movable between a folded position, in which said upper sidewall is folded within said lower sidewall such that said upper rim of said upper portion and. said top opening thereof is disposed generally adjacent to said upper edge of said lower portion, thereby defining an interior compartment of a certain size, and an extended position, in which said upper portion is unfolded and extended upwardly, thereby extending the height of said body and, in turn, said bag creating an interior compartment of a greater size.

A strap for supporting said body is secured to said upper portion generally adjacent to said upper rim thereof and releasable coupling means are also provided for releasably coupling said strap to said lower portion which serves to prevent movement of said upper portion from said folded to said extended position when so coupled and which, upon release thereof, permits extension of said upper portion.

Preferably, said releasable coupling means comprises at least one first member secured to said lower portion and at least one second member secured to said strap which first and second members are releasably coupled to one another. Advantageously, said strap has a pair of opposite ends, said lower portion is composed of at least two side panels joined at their opposite lateral and bottom edges, and said releasable coupling means comprises a pair of first members, each secured at an opposite end of said lower portion and a pair of second members, each secured generally adjacent to an opposite end of said strap. Desirably, said first member is a releasable clasp and said second member is ring. In a particularly preferred embodiment of the invention, the lower edge of said upper body is coupled adjacent to said upper rim of lower portion along an inside edge portion of said upper rim.

In a further embodiment of the invention, the expandable bag comprises a body having a top, a bottom, and a bead located between the top and bottom of the body defining a relatively flexible upper body portion and a relatively rigid lower body portion joined to said upper body portion via said bead, whereby the upper body portion is foldable into the lower body portion, a pair of spring clips coupled to opposite sides of the lower body portion, and a first pair of rings coupled to opposite sides of the upper body portion, said rings being engaged by said spring clips to prevent the upper body portion from unfolding out of the lower body portion.

In a further embodiment of the invention, a preferably adjustable shoulder strap is coupled to the top of said body, said first pair of rings are coupled to said shoulder strap and a second pair of rings are coupled to opposite sides of the upper body portion near the bead.

Most advantageously, reinforcing material is attached to the bottom of said body and/or to the sides of the body and said upper body portion is made of canvas-like material and said reinforcing material is vinyl or leather. Most desirably, a zipper is coupled to the top of said body and adapted to close the top. The bag preferably has a zippered pocket on a side of the body.

In a further embodiment of the invention, an expandable bag according to the invention comprises a body having a top and a bottom, an upper portion of the body being foldable into a lower portion of the body a shoulder strap attached to the top of said body, a pair of spring clips coupled to opposite sides of said body located between the top and the bottom of said body and a first pair of rings coupled to opposite sides of the top of said body, said rings being engaged by said spring clips to prevent the upper portion of the body from unfolding out of the lower portion of the body.

In yet a further embodiment of the invention, an expandable bag according to the invention comprises a body having a top and a bottom, an upper portion of the body being foldable into a lower portion of the body, a pair of spring clips coupled to opposite sides of said body located between the top and the bottom of said body, and a first pair of rings coupled to opposite sides of the top of said body, said rings being engaged by said spring clips to prevent the upper portion of the body from unfolding out of the lower portion of the body.

DETAILED DESCRIPTION

Figure 1:
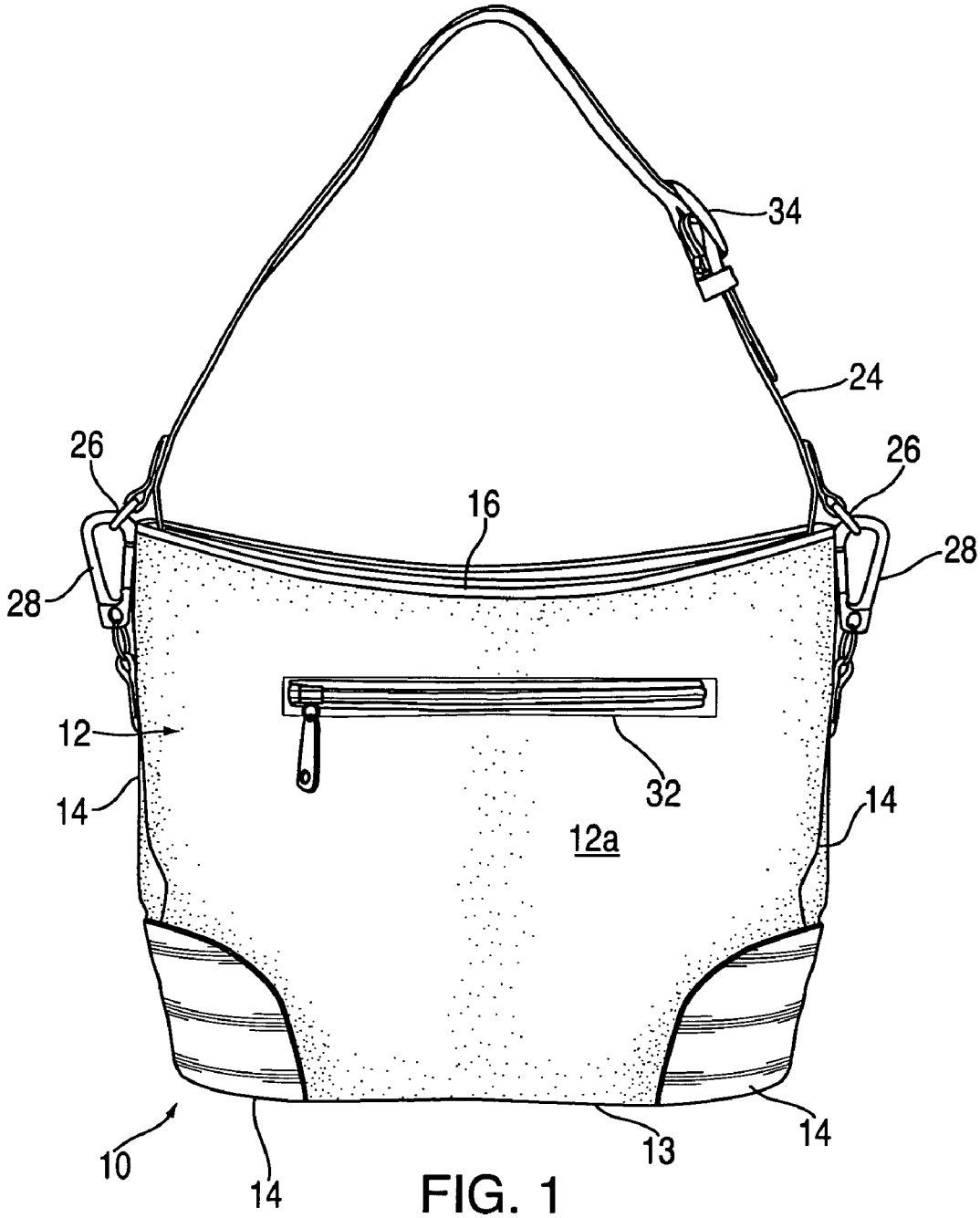
FIG. 1 is a side elevation view of an expandable bag according to the invention in the unexpanded configuration.
Figure 2:
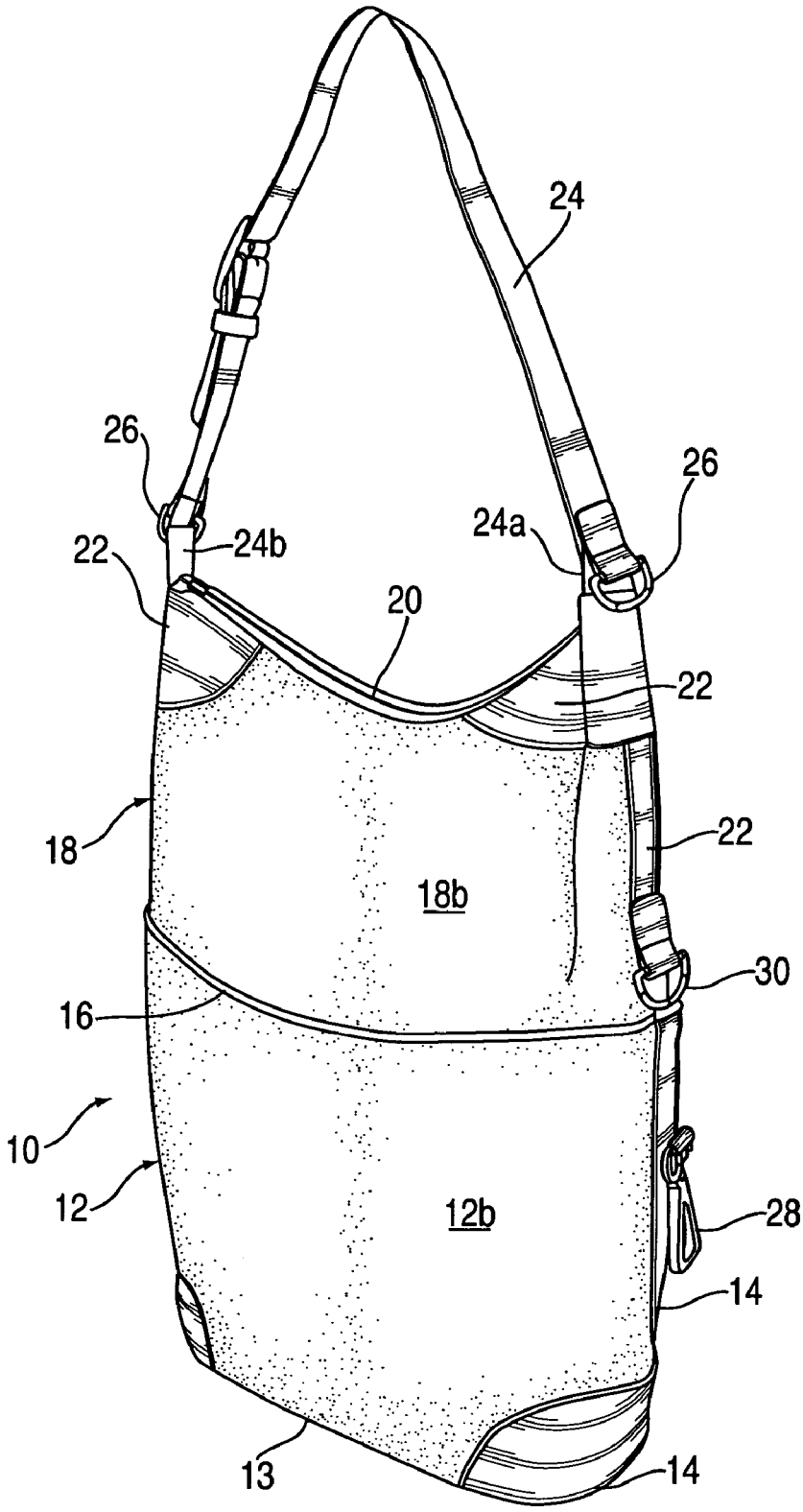
FIG. 2 is a perspective view of the bag in the expanded configuration.
Figure 3:
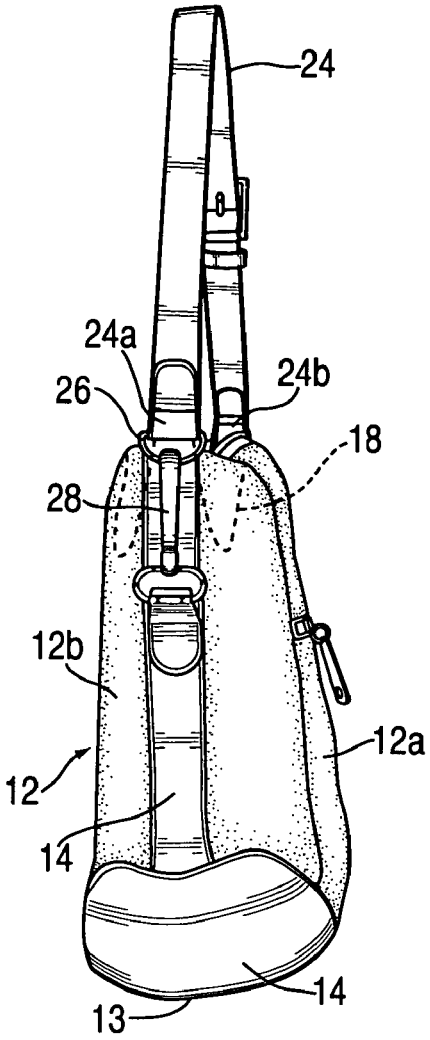
FIGS. 3–5 are side views of the bag illustrating the expansion process.
Figure 4:
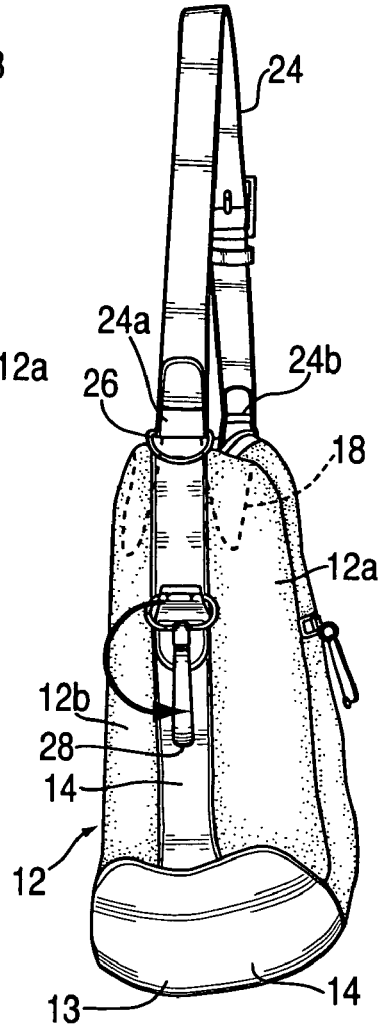
Figure 5:
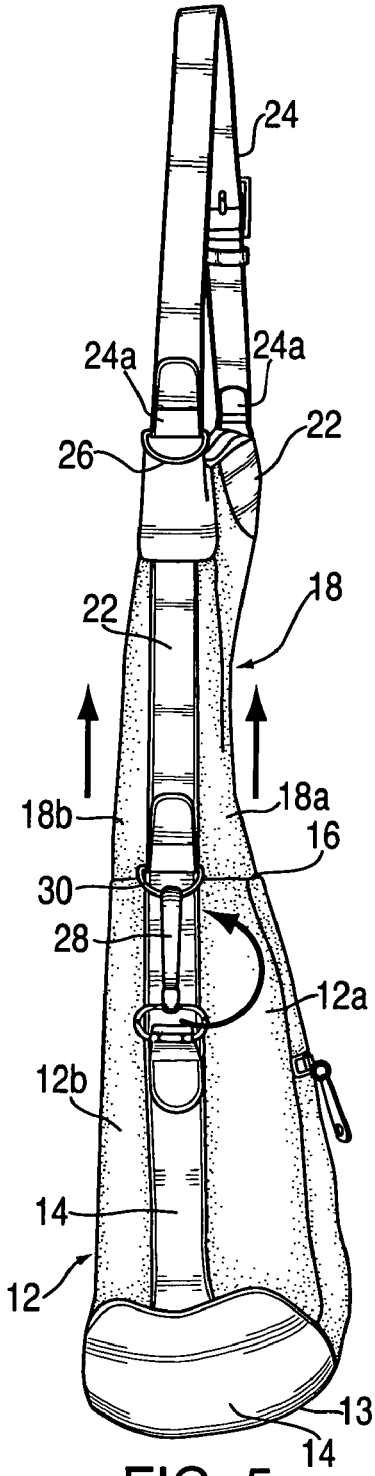
Figure 6:
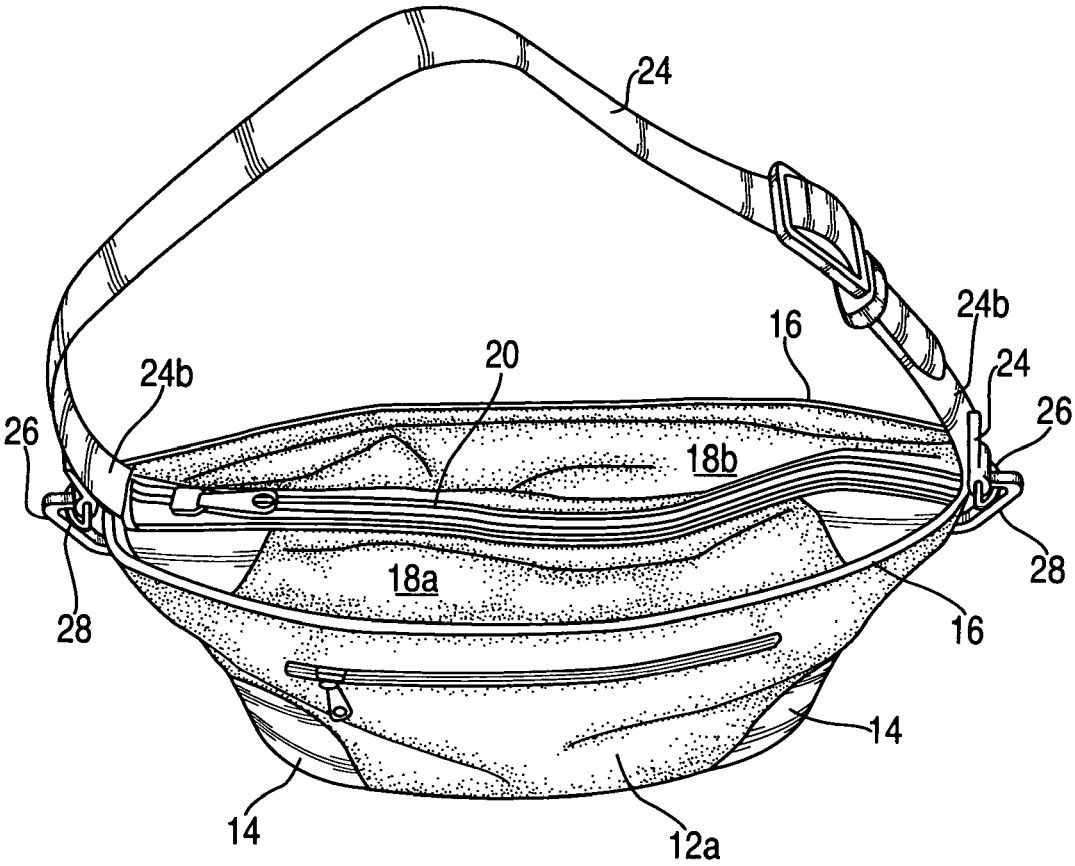
FIG. 6 is a perspective top view of the bag in the unexpanded configuration.

Referring to FIGS. 1 and 2, a bag 10 according to the invention is shown which includes a relatively rigid, lower body portion 12 comprised of a generally oval bottom wall 13 and a pair of generally rectangular side panels 12*a*, 12*b* which are stitched together along their opposite side edges and along their bottom edges to bottom wall 13 so as to define a shape which resembles a conventional bag or shoulder bag. The bag is generally comprised of a canvas body having a generally rectangular profile (FIG. 1) and a somewhat elliptical foot print (FIGS. 3–6). The bottom and the corners adjacent to the bottom as well as the sides are reinforced with vinyl or leather gussets 14. A preferably reinforced bead or rim 16 is provided near the top of the lower body portion 12 which generally defines the top of the unexpanded bag.

The bag also includes a relatively flexible, upper portion 18 (FIGS. 2–5) composed of generally rectangular side panels 18*a*, 18*b* which are stitched together along their opposite side edges. Upper portion 18 is also made of canvas. The upper corners of upper panels 18*a*, 18*b* are reinforced with vinyl or leather gussets 22 as are the side edges thereof.

Figure 7A:
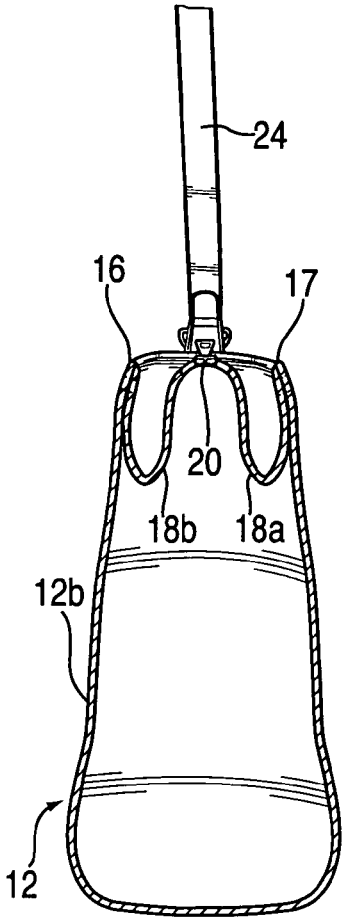
FIGS. 7*a,* 7*b,* and 7*c* are schematic side sectional views showing, respectively, the bag in the unexpanded configuration, partially expanded position and fully expanded position.
Figure 7B:
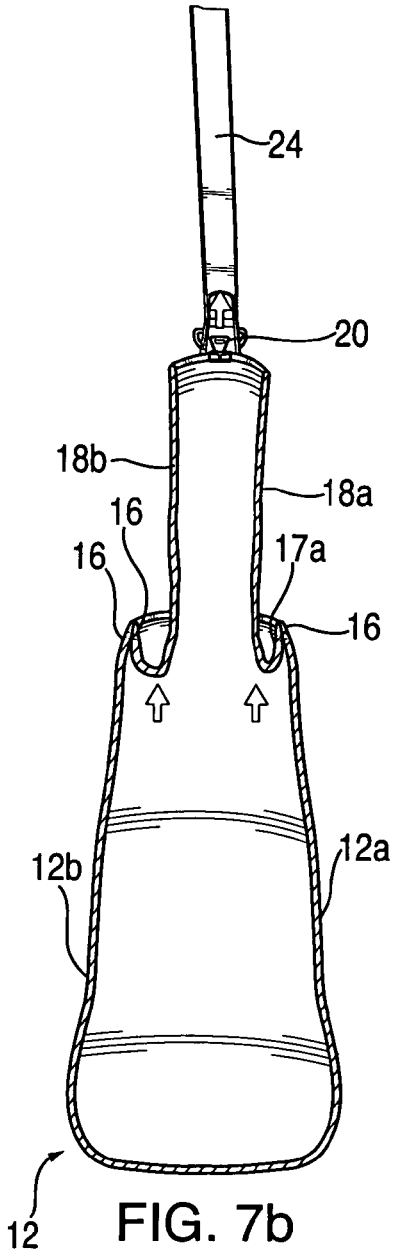
Figure 7C:
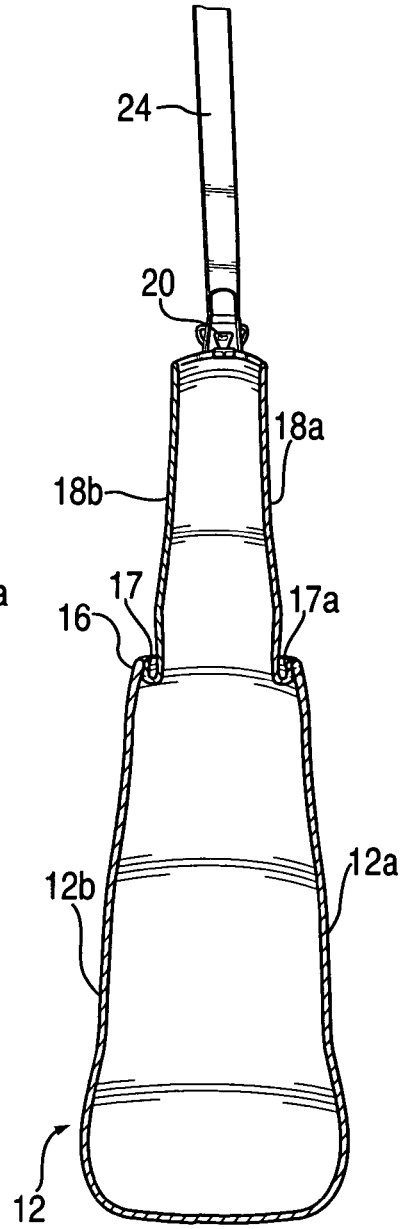

As seen best in FIGS. 7*a*, 7*b*, and 7*c*, upper portion 18*a* has a lower edge 17 and rim portion 17*a* adjacent thereto which is attached to the inside edge portion of rim 16 (preferably via stitching). In its folded position, the remainder of the upper body 18 is folded into the lower portion 12 of bag 10 via a generally U-shaped folding of each side panel 18*a*, 18*b* of the upper portion 18 when the bag is not expanded (FIGS. 1, 3, 4, 6, and 7*a*). The top edges of the panels 18*a*, 18*b* are joined via a zipper 20 to permit opening and closing of the top opening of the bag 10.

As seen best in FIG. 2, the ends 24*a*, 24*b* of a shoulder strap 24 are coupled (preferably via stitching) to opposite ends of the top of the bag upper portion 18 and zipper 20 and are each provided with one generally D-shaped ring or D-ring 26 (held via a reinforced loop). Mounted on each of the opposite side edges of the lower side panels 12*a*, 12*b*, spaced below bead 16 is a spring clip 28 (also attached via a ring to a reinforced loop on bag 12). When the bag is unexpanded (FIGS. 1, 3, 4, and 6), the spring clips 28 engage the D-rings 26 on the ends 24*a*, 24*b* of strap 24 and prevent the bag from expanding. In this folded position, bag 10 resembles a conventional bag and is not readily discernable as an expandable bag.

Uncoupling the spring clips 28 from the D-rings 26 on the strap ends 24*a*, 24*b* allows the bag to unfold as illustrated in FIGS. 3–5 and 7*a*, 7*b*, and 7*c*, thereby expanding its height and the size and capacity of its inner compartment. As seen best in FIG. 5, when the bag is unfolded, and extended upwardly, the spring clips 28 can be clipped to D-ring 30 mounted (via a reinforced loop) adjacent to the opposite edges of bag upper panels 18*a*, 18*b* adjacent to their bottom edge, thereby providing an aesthetically pleasing look and giving greater support to the shoulder strap 24.

Bag 10 is preferably provided with an exterior zippered pocket 32 and the shoulder strap 24 is preferably provided with an adjustment buckle 34. Though not illustrated, the bottom of the bag is preferably provided with four metallic feet. The interior of the bag may be provided with one or more pockets for keys, cell phone, etc.

There has been described and illustrated herein an expandable shoulder bag. While particular embodiments of the invention have been described, it is not intended that the invention be limited thereto, as it is intended that the invention be as broad in scope as the art will allow and that the specification be read likewise. For example, while the bag has been described as canvas-like, any suitable material and possibly leather could be used. In addition, although the bag has been defined as preferably having a substantially rectangular profile and an oval footprint, other configurations are, of course, possible, so long as the expansion feature of the bag is maintained in the manner contemplated herein. Furthermore, although the illustrated manner of attachment of the upper portion to the lower portion of the bag is especially preferred for ease of construction and use, other modes of attachment may be possible. Also while the reinforcements have been described as vinyl or leather, other reinforcing material could be used. In addition, while D-rings have been shown, it will be appreciated that rings having other shapes could be used as well. Similarly, although the clasp and loop fasteners are preferred, other well known releasable fasteners could be used to suit a particular bag style or design. It will therefore be appreciated by those skilled in the art that yet other modifications could be made to the provided invention without deviating from its spirit and scope as so claimed.

What is claimed is:

1. An expandable bag comprising:

a body having a relatively rigid, lower portion defining a closed bottom and a generally upstanding lower sidewall having an upper rim defining an upper opening, said lower sidewall being comprising at least two side panels joined at opposite lateral edges, and a relatively flexible upper portion defining an upper sidewall comprising at least two side panels joined at opposite lateral edges and having a lower edge coupled adjacent to said upper rim of said lower portion and having an upper rim defining a top opening, said upper portion being movable between a folded position, in which said upper sidewall is folded within said lower sidewall such that said upper rim of said upper portion and said top opening thereof is disposed generally adjacent to said upper rim of said lower portion, thereby defining an interior compartment of a certain size, and an extended position, in which said upper portion is unfolded and extended upwardly, thereby extending the height of said body and, in turn, said bag creating an interior compartment of a greater size;

a strap for supporting said body having a pair of opposite ends each secured to an opposite lateral edge of said upper sidewall of said upper portion generally adjacent to said upper rim thereof; and releasable coupling means for releasably coupling said strap to said lower portion which serves to prevent movement of said upper portion from said folded to said extended position when so coupled and which, upon release thereof, permits extension of said upper portion, said releasable coupling means comprising a pair of first members, each secured at an opposite end of said lower sidewall and a pair of second members, each secured generally adjacent to an opposite end of said strap, with said first members each being releasably coupled to one of said second members.

2. The expandable bag according to claim 1, wherein said first member is a releasable clasp and said second member is ring.

3. The expandable bag according to claim 1, wherein lower edge of said upper body is coupled adjacent to said upper rim of lower portion along an inside edge portion of said upper rim.

4. An expandable bag comprising:

a body having a top, a bottom, and a bead located between the top and bottom of the body defining a relatively flexible upper body portion and a relatively rigid lower body portion joined to said upper body portion via said bead, whereby the upper body portion is foldable into the lower body portion;

a pair of spring clips coupled to opposite sides of the lower body portion; and a first pair of rings coupled to opposite sides of the upper body portion, said rings being engaged by said spring clips to prevent the upper body portion from unfolding out of the lower body portion.

5. The bag according to claim 3, further comprising a shoulder strap coupled to the top of said body.

6. The bag according to claim 5, wherein said first pair of rings are coupled to said shoulder strap.

7. The bag according to claim 6, further comprising a second pair of rings coupled to opposite sides of the upper body portion near the bead.

8. The bag according to claim 7, further comprising reinforcing material attached to the bottom of said body.

9. The bag according to claim 8, further comprising reinforcing material attached to the sides of the body.

10. The bag according to claim 9, further comprising a zipper coupled to the top of said body and adapted to close the top.

11. The bag according to claim 10, wherein said upper body portion is made of a canvas-like material and said reinforcing material is selected from the group consisting of vinyl and leather.

12. The bag according to claim 6, further comprising a zippered pocket on a side of the body.

13. The bag according to claim 5, wherein said shoulder strap is adjustable.

14. An expandable bag comprising:

a body having a top and a bottom, an upper portion of the body being foldable into a lower portion of the body;

a shoulder strap attached to the top of said body;

a pair of spring clips coupled to opposite sides of said body located between the top and the bottom of said body; and a first pair of rings coupled to opposite sides of the top of said body, said rings being engaged by said spring clips to prevent the upper portion of the body from unfolding out of the lower portion of the body.

15. The bag according to claim 14, wherein said first pair of rings are coupled to said shoulder strap.

16. The bag according to claim 15, further comprising a second pair of rings coupled to opposite sides of the upper portion of the body near the lower portion of the body.

17. The bag according to claim 16, further comprising reinforcing material attached to the bottom of said body.

18. The bag according to claim 17, further comprising reinforcing material attached to the sides of the body.

19. The bag according to claim 18, further comprising a zipper coupled to the top of said body and adapted to close the top.

20. The bag according to claim 19, wherein said reinforcing material is selected from the group consisting of vinyl and leather.

21. The bag according to claim 20, further comprising a zippered pocket on a side of the body.

22. The bag according to claim 21, wherein said shoulder strap is adjustable.

23. An expandable bag, comprising:

a body having a top and a bottom, an upper portion of the body being foldable into a lower portion of the body;

a pair of spring clips coupled to opposite sides of said body located between the top and the bottom of said body; and a first pair of rings coupled to opposite sides of the top of said body, said rings being engaged by said spring clips to prevent the upper portion of the body from unfolding out of the lower portion of the body.

* * * * *